United States Patent [19]

Rakowicz et al.

[11] Patent Number: 4,704,054

[45] Date of Patent: Nov. 3, 1987

[54] TOBACCO FEEDING DEVICE FOR CIGARETTE MAKING MACHINE

[75] Inventors: Jan A. Rakowicz; Brian Hodsall, both of Deptford, England

[73] Assignee: Molins Ltd., London, England

[21] Appl. No.: 882,719

[22] Filed: Jul. 7, 1986

Related U.S. Application Data

[63] Continuation of Ser. No. 728,870, Apr. 30, 1985, abandoned, which is a continuation of Ser. No. 309,091, Oct. 6, 1981, abandoned, which is a continuation of Ser. No. 197,152, Oct. 15, 1980, abandoned, which is a continuation of Ser. No. 902,969, May 4, 1978, abandoned.

[30] Foreign Application Priority Data

May 10, 1977 [GB] United Kingdom ..... 19615/77

[51] Int. Cl.[4] ..... B65G 53/66; B65G 53/60

[52] U.S. Cl. ..... 406/28; 406/171

[58] Field of Search ..... 406/28, 168, 169, 171, 406/172

[56] References Cited

U.S. PATENT DOCUMENTS

| | | | |
|---|---|---|---|
| 2,812,217 | 11/1957 | Koch et al. | 406/171 |
| 3,580,644 | 5/1971 | Ballard | 406/171 X |
| 3,580,645 | 5/1971 | Hagenah | 406/171 |
| 3,829,165 | 8/1974 | Boon | 406/171 |

FOREIGN PATENT DOCUMENTS

| | | | |
|---|---|---|---|
| 2328178 | 6/1975 | Fed. Rep. of Germany . | |
| 302412 | 12/1978 | United Kingdom | 406/171 |

*Primary Examiner*—Jeffrey V. Nase

*Attorney, Agent, or Firm*—Antonelli, Terry & Wands

[57] ABSTRACT

A tobacco discharge unit for the hopper of a continuous-rod cigarette making machine which is arranged to prevent excessive packing of the tobacco at the end opposite the inlet of the unit. This is achieved by means of movable shutters on the filter screen separating the upper and lower compartments of the unit so as to modify the air flow pattern in the unit, or by means of a specially shaped "stepped" screen or by means of deflector baffles in the lower compartment.

14 Claims, 8 Drawing Figures

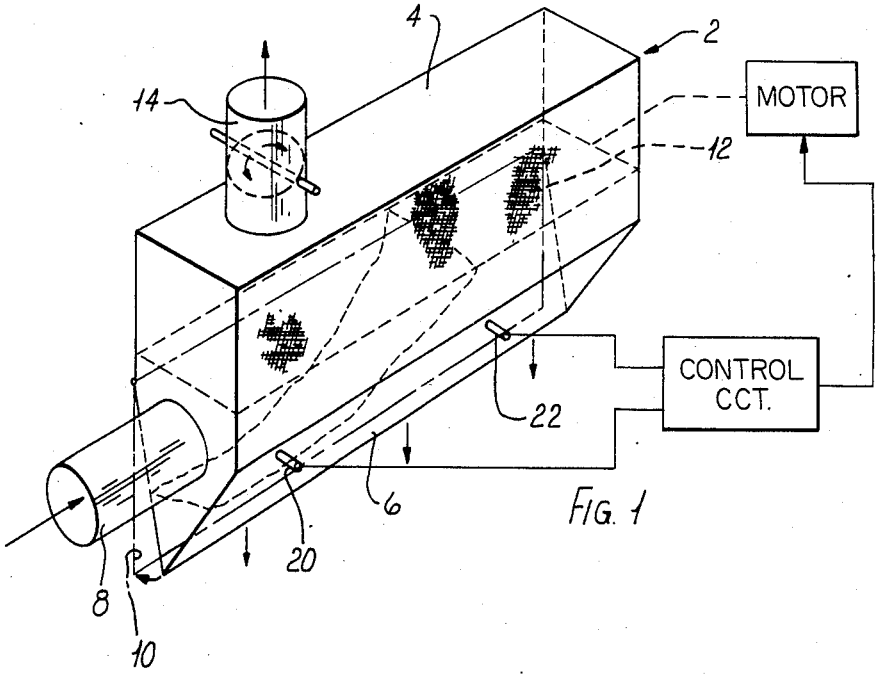
FIG. 1
FIG. 2
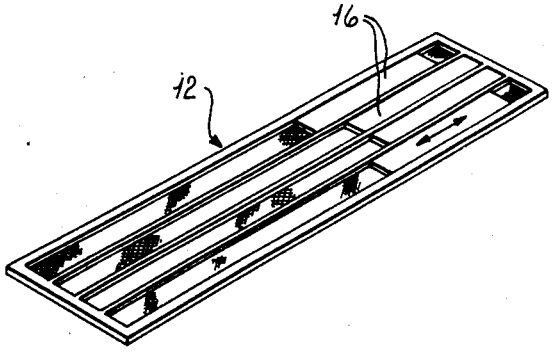

FIG. 3
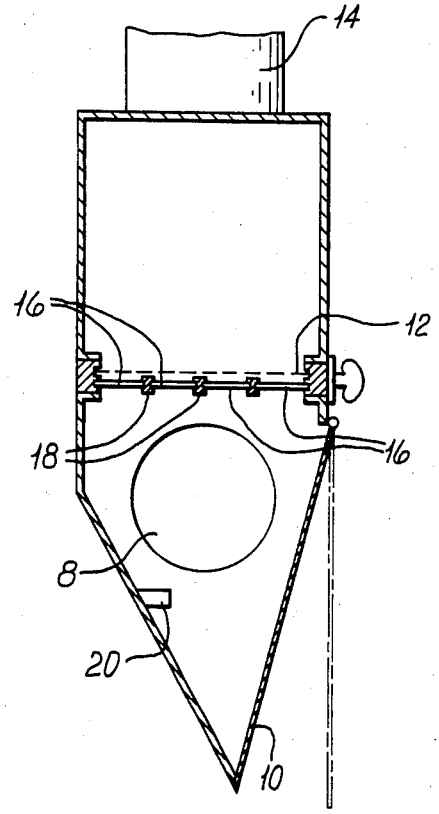
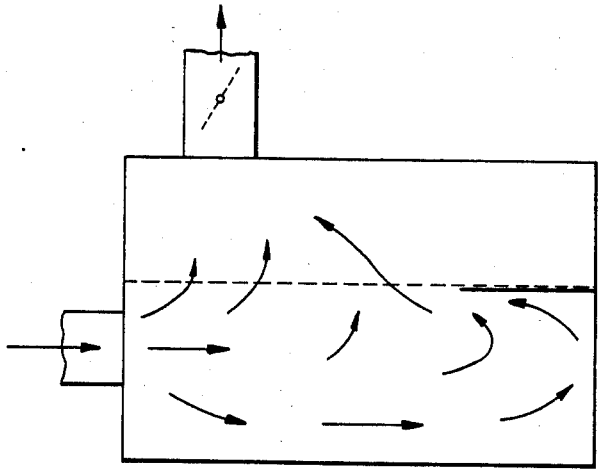
FIG. 4a

TOBACCO FEEDING DEVICE FOR CIGARETTE MAKING MACHINE

This is a continuation of application Ser. No. 728,870, filed Apr. 30, 1985, now abandoned, which is a continuation of application Ser. No. 309,091, filed Oct. 6, 1981, now abandoned, which is a continuation of application Ser. No. 197,152, filed Oct. 15, 1980, now abandoned, which is a continuation of application Ser. No., 902,969, filed May 4, 1978, now abandoned.

This invention relates to devices for feeding fillers such as tobacco to cigarette making machines.

In systems in which the tobacco is distributed pneumatically to the making machines from a central source, a receiving unit is usually provided for each making machine to control the intake of tobacco in such a way that it can be supplied to the hopper of the making machine in uniformly distributed batches when required.

The hopper of the making machine is in the form of an elongate trough, and the receiving unit is mounted above it. The tobacco is normally delivered to the receiving unit in a direction parallel to the length of the trough. The receiving unit consists of an upper and a lower compartment separated by a screen. The tobacco is delivered pneumatically into the lower compartment, in which it accumulates, while the air which carries it passes through the screen and out through the upper compartment. The base of the lower compartment includes a hinged flap which is held closed by maintaining the air in the unit at a pressure below atmospheric pressure, until the tobacco is to be discharged when the pressure is allowed to equalise with atmospheric pressure and the flap falls open.

Because the tobacco is fed into the unit at a high speed to enable it to be charged quickly, it tends to accumulate at the end of the unit opposite the inlet, whereas it should preferably be distributed as evenly as possible along the length of the unit, so as to supply tobacco evenly along the width of the hopper. It is an aim of the present invention to provide a receiving unit which is so arranged that tobacco entering it is distributed more evenly along its length than was possible previously.

A tobacco receiving unit in accordance with one aspect of the present invention comprises a container divided into two internal compartments, a lower compartment having an inlet at one end for receiving pneumatically transported tobacco, and having an outlet for discharging tobacco from its base and an upper compartment having an outlet for air, the compartments being separated by a filter screen which allows air to pass into the upper compartment and also comprising tobacco distributing means which is so arranged that when charging of the unit commences, some of the tobacco entering the lower compartment is caused to stop moving before reaching the end of the lower compartment remote from the inlet. The inlet conduit may be flared where it joins the receiving unit so as to reduce the velocity of the tobacco and thus further reduce the tendency for it to accumulate at the end remote from the inlet.

Preferably the air outlet is situated at the same end of the unit as the inlet.

In a preferred unit according to this invention the filter screen permits air flow through it directly from the lower compartment in a region near the inlet, but not in a region further from the inlet. This reduces the tendency of the initial tobacco to pack firmly into the end of the lower compartment remote from the inlet. In other words, some of the tobacco which would, in previously proposed units, have packed into the remote end, stops short of the end, thus improving the distribution of tobacco along the lower compartment.

In this preferred unit the upper and lower compartments and the filter screen are preferably of substantially the same length, and the region of the screen remote from the inlet is blanked off by an adjustable blanking member which stops or restricts air flow through the screen in that region. Alternatively, if adjustment is not required, the lower compartment may simply extend along a greater distance from the inlet than the screen and upper compartment.

The blanking means may for example comprise slideable shutters running in guideways on the screen. They may either be manually adjustable, or they may be arranged to be moved automatically in response to the output of a control circuit including pressure sensitive, or optical detectors (for example) in the lower compartment, or in the hopper of the making machine. This control circuit provides a control signal dependent upon the distribution of tobacco in the unit, or in the maker hopper, at any instant. This signal activates a motor driving the shutters, so that if an undesirably large quantity of tobacco tends to accumulate at the end opposite the inlet, the shutters are moved to the corresponding end of the guideways. Conversely if insufficient tobacco is reaching the end, the shutters are moved away from that end.

In another embodiment of the invention, the screen comprises two sections at different levels, one section being nearer the inlet end and the other section being nearer the opposite end and also being nearer the base of the unit, the arrangement being such that a longitudinally extending vertical cross-section through the unit is "stepped". The air stream impinges upon this step in use and some of the tobacco is trapped by it so that a proportion of the incoming tobacco is trapped against the step, instead of being carried right to the end opposite the inlet. Alternatively the screen may be formed with a series of such steps so that the lower compartment is effectively progressively reduced in depth towards the end opposite the inlet.

In another arrangement a series of flow interrupting members are arranged across the path of the incoming tobacco, situated towards the end opposite the inlet, so as to physically break up the flow and deflect some of the tobacco downwards towards the base of the unit before it reaches the extreme end.

Some embodiments of the invention will now be described by way of example with reference to the accompanying drawings in which:

FIG. 1 is a diagrammatic perspective view of a discharge unit in accordance with one aspect of the invention;

FIG. 2 is a perspective view of part of the unit of FIG. 1;

FIG. 3 is a transverse cross section through the unit of FIG. 1;

Figure 4B:
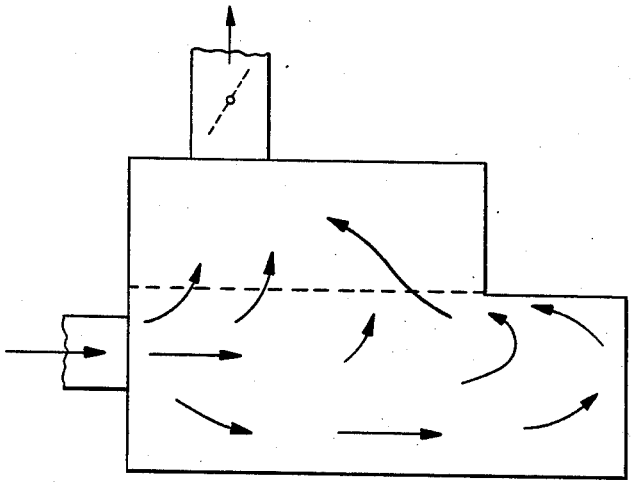
Figure 5A:
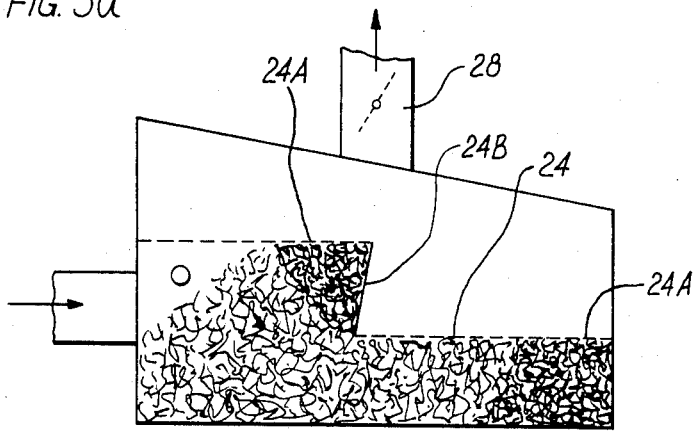
Figure 5B:
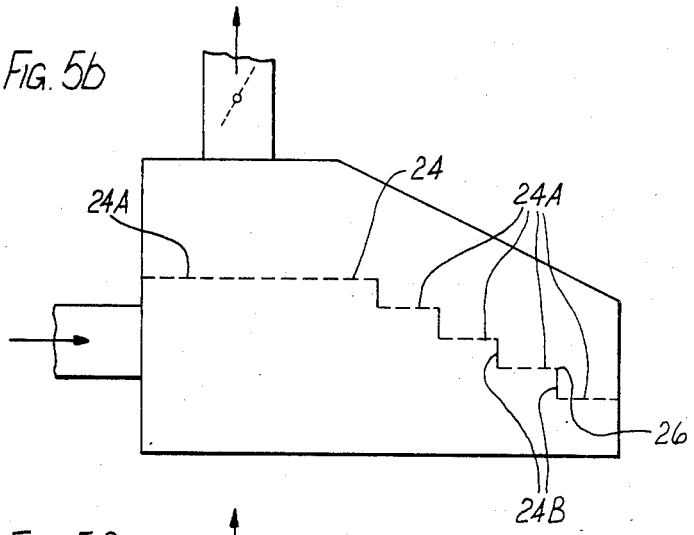
Figure 5C:
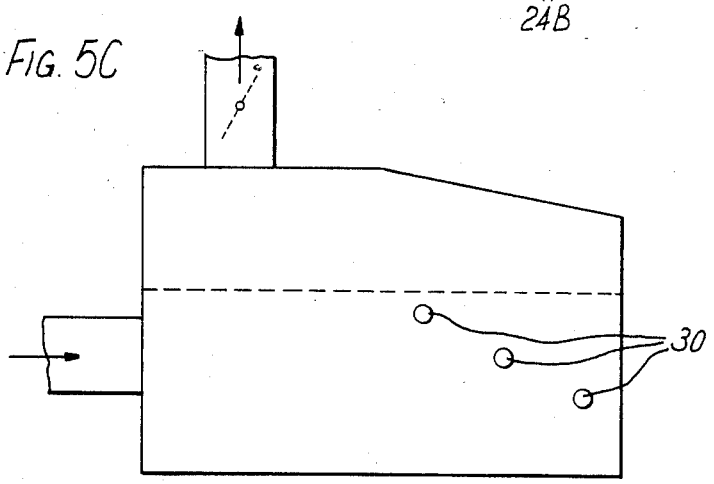

FIG. 4*a* is a diagrammatic vertical cross-section through the unit of FIG. 1 showing air-flow paths;

FIG. 4*b* is a diagrammatic vertical cross-section through a modified discharge unit in accordance with the present invention showing air flow paths; and FIGS. 5(*a*), 5(*b*) and 5(*c*) are further alternative forms of discharge units in accordance with the invention.

Referring first to FIG. 1, the unit comprises a container generally designated by the reference numeral 2 which is divided into upper and lower internal compartments 4 and 6 respectively. The lower compartment 6 has an inlet of feed conduit 8 for an air stream carrying tobacco into the compartment and a discharge flap 10 which is hinged along its upper edge and which is closed while the unit is being charged. The charge and discharge sequence is as follows:

When a signal from the maker indicates that the making machine requires a charge of tobacco the air valve in the air exhaust or outlet pipe 14 is opened. This allows air to flow from the air inlet 8 through the screen 12 and air chamber to the air exhaust pipe 14. A reduction in pressure is created in the unit causing the hinged discharge flap 10 of the charge area to close.

Tobacco is now introduced into the feed pipe 8. The conveying air is drawn through the screen 12 and exhausted through the air exhaust pipe 14. The conveyed tobacco enters the charge area at approximately 60 ft./sec. and continues until a signal is given by a detector 20 which closes the air valve in the air exhaust pipe 14.

A time delay may be introduced between the detector signal and the closing of the valve. This can be used to cease introducing tobacco into the feed pipe and allow all tobacco in the line to reach the discharge unit before the air valve closes. When the air valve closes the pressure in the unit equalises with atmospheric pressure and the hinged flap 10 opens and allows the tobacco to fall from the charge area.

The exhaustor outlet pipe 14 in the upper compartment 4 is shown as being situated in the top wall to the upper compartment 4, at the same end as the inlet 8. It may alternatively be situated in the same end wall as the inlet 8, rather than in the top of the unit, but in any case it is preferably nearer the inlet end than the opposite end. As shown in FIG. 2 screen 12, comprises a perforated metal grid or woven mesh in a frame which is slidably mounted in the unit so that it can be withdrawn for cleaning and adjustment which also includes (in this embodiment) four parallel guideways for longitudinally extending sliding blanking members or shutters 16. As shown in FIG. 3, the guideways comprise spaced apart channel member 18. These shutters 16 may be arranged to various positions on the screen, so as to modify the air flow path through it. For example they may all be positioned at the end opposite the inlet 8, so as to create an air flow pattern as shown in FIG. 4*a*. Instead of extending along the length of the unit, as shown, the shutter may alternatively comprise strips extending across its width, so that only one guideway is required, comprising one inwardly facing channel member along each long edge of the screen to engage the ends of all the strips. Additionally, as shown in FIG. 4*b*, the upper compartment may be shorter than the lower compartment, with the length of the filter screen corresponding to that of the upper compartment.

The shutters 16 may be manually positioned so as to provide the optimum packing pattern for any particular mode of operation, as determined experimentally, or alternatively they may be movable by means of a motor controlled by detectors 20 in the lower compartment 6. These detectors 20 may, for example, detect the local density of tobacco optically. Thus, referring once more to FIG. 1, a detector 20 may be provided near the inlet end and a detector 22 near the opposite end. If the detectors 22 indicate that a sufficient quantity of tobacco has reached the end remote from the inlet before the unit has filled sufficiently at the inlet end, the motor will be actuated to move the shutters 16 away from the inlet end so that the tobacco then builds up more rapidly at the inlet end. In order to further reduce the tendency for the tobacco to accumulate at the end remote from the inlet, the inlet conduit 8 may be flared so as to allow the incoming air to expand just before entering the unit and thus undergo a reduction of velocity.

Instead of providing movable shutters 16 on the screen 12, the flow of the tobacco through the lower compartment 6 may be modified in other ways. For example the unit may be provided with a dividing wall 24 which is stepped as shown in FIGS. 5(*a*) or 5(*b*), the horizontal parts 24A comprising air pervious screens which the vertical parts 24B are a solid wall. The single step shown in FIG. 5(*a*) acts as a trap for the tobacco so that a relatively high proportion is retained near the inlet end. The position of the air exhaust pipe 28 is modified as shown to assist this effect. The gradual reduction in effective depth provided by the series of steps 26 in the screen of FIG. 5(*b*) reduces the space in which the tobacco can be packed at the end of the unit so that although the density at the end may be relatively high, the mass is reduced correspondingly to compensate.

The arrangement of FIG. 5(*c*) uses a standard type of screen, but includes transversely extending members 30 in the lower compartment of the unit which are arranged so that their interference with the incoming tobacco progressively increases towards the end of the unit opposite the inlet, so that a proportion of the tobacco which would otherwise reach the end is stopped.

We claim:

1. A tobacco receiving unit for mounting above a hopper of a cigarette making machine and for feeding a substantially uniform distribution of tobacco across a width of the hopper comprising: a first horizontal elongate compartment in a lower part of the unit and into which tobacco is to be introduced so as to be accumulated therein; an inlet for pneumatically transported tobacco at one end of said first compartment; an outlet for discharging accumulated tobacco into said hopper from a base of the first compartment; a second horizontally extending elongate compartment in an upper part of the unit and elongated in the same direction as the first compartment; an outlet for air in said second compartment; a filter screen disposed between said first and second compartments and arranged to pass air into the second compartment from said first compartment; blanking means selectively positioned along said filter screen for selectively restricting air flow through said filter screen from the first to the second compartments at least in a region at the end of the first compartment remote from said inlet, at least a portion of said blanking means being adjustable so as to enable restriction of the flow through different areas of the filter screen; and means mounting said blanking means so as to be stationary during operation of the unit filter screen and allow the selective positioning of said blanking means along said filter screen.

2. A tobacco receiving unit according to claim 1, wherein said blanking means comprises at least one sliding shutter mounted in guideways so as to be slidable over different areas of the screen.

3. A tobacco receiving unit as claimed in claim 1, wherein the inlet is adapted to introduce air borne tobacco into the first compartment horizontally in the direction of the length of said first compartment.

4. A tobacco receiving unit for mounting above a hopper of a cigarette making machine for feeding a substantially uniform distribution of tobacco across a width of the hopper comprising: a first elongated compartment in a lower part of the unit and into which tobacco is to be introduced so as to be accumulated therein; an inlet for pneumatically transported tobacco at one end of said first compartment; an outlet for discharging into said hopper, from the first compartment, tobacco which accumulates in the first compartment; a second elongate compartment in an upper part of the unit; an outlet for air in said second compartment; a filter screen between said first and second compartments and arranged to pass air into the second compartment from said first compartment; flow control means mounted in the air flow path through the unit, said flow control means being adjustable for selectively controlling a passage of air through said filter screen at least in a region at the end of said first compartment remote from said inlet and, as a consequence, a distribution of tobacco accumulating in the first compartment; detection means for detecting the tobacco accumulating in the first compartment; and control circuit means responsive to said detection means for automatically controlling a position of the blanking means.

5. A tobacco receiving unit as claimed in claim 4, wherein said blanking means comprises at least one sliding shutter mounted in guideways so as to be slidable over different areas of the screen.

6. A tobacco receiving unit for mounting above a hopper of a cigarette making machine and for feeding a substantially uniform distribution of tobacco across a width of the hopper comprising: a first horizontally extending elongate compartment in a lower part of the unit and into which tobacco is to be introduced so as to be accumulated therein; an inlet for pneumatically transported tobacco at one end of said first compartment; an outlet for discharging tobacco into said hopper from a base of the first compartment; a second horizontally extending elongate compartment in an upper part of the unit and elongated in the same direction as the first compartment; an outlet for air in said second compartment; a filter screen disposed between said first and second compartments and arranged to pass air into the second compartment from said first compartment; blanking means selectively positionable along said filter screen for selectively controlling the permeability of said filter screen at least in a region at the end of the first compartment remote from said inlet; and means mounting said blanking means so as to be stationary during operation of the tobacco receiving unit and allow the selective positioning of said blanking means along said filter screen.

7. A tobacco receiving unit according to claim 6, wherein said blanking means includes a series of transversely extending baffles.

8. A tobacco receiving unit as claimed in claim 6, wherein the inlet is adapted to introduce air borne tobacco into the first compartment horizontally in the direction of the length of said first compartment.

9. A tobacco receiving unit for a hopper of a cigarette making machine and for feeding a substantially uniform distribution of tobacco across a width of said hopper comprising: a first horizontally extending elongate compartment in a lower part of the unit and into which tobacco is to be introduced so as to be accumulated therein; an inlet for pneumatically transported tobacco at one end of said first compartment; an outlet for discharging accumulated tobacco into said hopper from a base of the first compartment; a second horizontally extending elongate compartment in an upper part of the unit and elongated in the same direction as the first compartment; an outlet for air in said second compartment; a filter screen between said first and second compartments and arranged to pass air from said first compartment into the second compartment; blanking means selectively located along said filter screen at least in a region at the end of the first compartment remote from the inlet for selectively restricting the air flow through said filter screen from the first compartment to the second compartment while permitting an unrestricted air flow through said filter screen from the first to the second compartment in an area adjacent to the inlet; and means mounting said blanking means so as to be stationary during operation of the tobacco receiving unit and allow the selective positioning of said blanking means along said filter screen.

10. A tobacco receiving unit according to claim 9, wherein the air outlet of the second compartment is situated near the inlet end of the unit.

11. A tobacco receiving unit as claimed in claim 9, wherein the inlet is adapted to introduce air borne tobacco into the first compartment horizontally in the direction of the length of said first compartment.

12. A tobacco receiving unit for a hopper of a cigarette making machine and for feeding a substantially uniform distribution of tobacco across a width of the hopper comprising: a lower horizontal elongate chamber for accumulating tobacco therein and having an air pervious upper wall, an inlet at one end for receiving pneumatically fed tobacco, and a lower wall which is movably mounted for releasing accumulated tobacco from the lower chamber when tobacco is to be discharged into said hopper; and an upper horizontal elongate chamber elongated in the same direction as the lower chamber and communicating with the lower chamber through the air pervious wall and having an outlet for air; wherein the lower chamber comprises a first elongate portion extending from the inlet and allowing substantially unrestricted passage for air and tobacco along part of the length of the lower chamber, the air being able to leave said first portion by passing through the air pervious wall, and a second portion situated further from the inlet, and at lest including the end of the first elongate portion remote from the inlet, for receiving part of the tobacco entering the lower chamber, but having selectively positionable air obstructing means on an upper wall thereof for at least restricting an outflow of air from the second portion of the lower chamber, and means mounting said obstructing means so as to be stationary during operation of the tobacco receiving unit and allow the selective positioning of said obstructing means along said air pervious wall.

13. A tobacco receiving unit as claimed in claim 12, wherein the inlet is adapted to introduce air borne tobacco into the lower compartment horizontally in the direction of the length of the lower compartment.

14. A tobacco receiving unit for mounting above a hopper of a cigarette making machine and for feeding a substantially uniform distribution of tobacco across a width of the hopper comprising: a first horizontally extending elongate compartment in a lower part of the tobacco receiving unit and into which tobacco is to be introduced so as to be accumulated therein; an inlet for pneumatically transported tobacco at one end of the said first compartment; an outlet for discharging into said hopper from the first compartment, tobacco which accumulates in the first compartment; a second horizontally extending elongate compartment in an upper part of the tobacco receiving unit and being elongated in the same direction as the first compartment; an outlet for air in said second elongate compartment; and a filter screen between said first and second elongate compartments and arranged to pass air into the second compartment from said first compartment, wherein the filter screen is divided into at least two sections arranged at different horizontal levels, the lower levels being arranged successively further from the inlet so that the screen is stepped downwardly, a riser of the step or each step being blocked so that tobacco is trapped behind it in use when the tobacco receiving unit is charged.

* * * * *